US005397138A

United States Patent [19]

Mangelsdorf

[11] Patent Number: 5,397,138

[45] Date of Patent: Mar. 14, 1995

[54] BRAKING MECHANISM FOR IN-LINE SKATE

[76] Inventor: Gary Mangelsdorf, 8400 Grizzly Way, Evergreen, Colo. 80439

[21] Appl. No.: 183,811

[22] Filed: Jan. 21, 1994

[51] Int. Cl.[6] ..... A63C 17/14

[52] U.S. Cl. ..... 280/11.2; 280/11.22; 280/11.28

[58] Field of Search ..... 280/11.2, 811, 11.22, 280/11.23, 11.28; 188/5

[56] References Cited

U.S. PATENT DOCUMENTS

| | | | |
|---|---|---|---|
| 3,900,203 | 8/1975 | Kukulowicz | 280/11.2 |
| 4,273,345 | 6/1981 | Ben-Dor et al. | 280/11.2 |
| 4,382,605 | 5/1983 | Hegna | 280/11.2 X |
| 4,991,861 | 2/1991 | Carn et al. | 280/11.2 X |
| 5,125,687 | 6/1992 | Hwang | 280/11.2 X |

FOREIGN PATENT DOCUMENTS

| | | | |
|---|---|---|---|
| 0114131 | 7/1984 | European Pat. Off. | 280/11.2 |
| 849 | of 1875 | United Kingdom | 280/11.2 |

*Primary Examiner*—Karin L. Tyson
*Assistant Examiner*—Carla Mattix
*Attorney, Agent, or Firm*—Charles C. Corbin

[57] ABSTRACT

Disclosed is an in-line roller skate including an elongate base plate having a top side to which a boot is secured, and an underside that mounts four wheel assemblies, the front wheel assembly having a fixed orientation and the remaining assemblies each having a caster-like construction. Springs bias each of the caster-like assemblies in a straight-ahead orientation, and first and second near-vertically extending fixed brake surfaces are spaced on opposite sides of the rearwardmost wheel such that the wheel frictionally engages a brake surface whenever the wheel is substantiallly turned to one direction or the opposite direction.

7 Claims, 1 Drawing Sheet

BRAKING MECHANISM FOR IN-LINE SKATE

BACKGROUND OF THE INVENTION

1. Field of the Invention

This invention pertains to an in-line skate, and more particularly, to a braking device for an in-line skate, such brake as will closely simulate the sideways braking action of a hockey skate or snow ski. The brake system can be for new in-line skates or retrofitted to an existing in-line skate.

2. Description of the Prior Art

In-line skating has become a popular form of exercise and sport worldwide, to the extent that there now exist indoor hockey rinks built solely for the use of roller hockey. In-line skaters, especially those playing roller hockey, often resort to the same type of braking action used by ice skaters, commonly referred to as a "hockey stop." This is not always effective because the skaters are not always able to stop their motion, or, at best, are able to stop their motion only within the wide arc created by the lead skate in said braking motion. In fact, almost all of the braking occurs, not by turning the skate, but by dragging the rear skate along the ground. One problem is that currently available in-line skates are ill-equipped for turning, the wheels being fixed in a straight-line orientation.

At present, the most widely used braking mechanism available for in-line skates is one which is secured to the rear portion of the boot and which comprises a flat fixed brake pad intended to abrade the skating surface. The skater applies the brake by extending the skate slightly forward and lifting the front wheels off the ground, thereby applying the rear brake pad to the skating surface and frictionally stopping the forward motion of the skater. This mechanism is undesirable in that it requires the user to thrust his foot forward of his body, thus putting him in an awkward and out-of-balance position. Said motion becomes even more difficult on uneven or pitched terrain. U.S. Pat. No. 5,028,058 typifies this type of brake on currently available in-line skates, and similar mechanisms can be found described in U.S. Pat. Nos.: 5,067,736; 5,183,275; 5,192,088; and 5,197,572.

Two other patents circumvent this foot-tilting problem through the use of a mechanically-operated rear pad (U.S. Pat. No. 5,211,409) and a hand-held lever-and-cable caliper system (U.S. Pat. No. 5,239,941). In both cases, the skater squeezes hand levers connected to cables running out his arms and down his sides and legs to the skate. In the former case, the cable connects to a rocker arm which pivots a rear brake pad to the ground. In the latter case, the cable connects to caliper-type brake pads, mounted to the sides of the wheel(s). By squeezing the hand lever, the user forces the brake pads into the sides of the wheel(s), thus forcing the skate to stop. These two systems are ineffective because they are both cumbersome and dangerous, dangerous because the skater's hands are never free of the levers in case he needs them to break a fall or regain his balance by grabbing onto something.

A brake system described in U.S. Pat. No. 5,207,438 calls for a toe-mounted brake. In use, the skater extends his foot rearwardly to position a rotatable cylinder, mounted on the toe of the boot, onto the skating surface, thereby creating enough friction between the cylinder and the ground to slow the forward motion of the skate. This system is undesirable because it places the skater in an awkward, unbalanced position, the rear skate being too difficult to control as one rolls along.

SUMMARY OF THE INVENTION

In view of the foregoing problems and disadvantages associated with the prior art, it is a general object of the present invention to provide a braking mechanism for in-line skates which is capable of applying large magnitude braking forces to the skate in a controlled, sideways motion, similar to that typically used by ice skaters and snow skiers.

Another object of this invention is to ensure that the skate retains adequate forward bias and lateral resistance within the wheel supports themselves to allow the skater to easily propel the skate forward when not braking.

A further object is to allow the skate wheel to pivot about a vertical axis so that when the skater turns his foot sideways, the wheel of the skate is pressed against a brake surface located inside the side plate provided with the new braking system.

An additional object of this invention is to allow a quicker, more controlled stopping motion than is currently available with in-line skates.

Yet another object of the present invention is to provide a brake that reduces vibrations transmitted to the skates on uneven or sloped surfaces, thereby making skating safer on all non-slip surfaces of any reasonable pitch.

The foregoing objects and advantages are provided by the present invention which includes an elongate base plate having a longitudinal axis, a top and an underside having a boot secured thereto, and the underside having a plurality of wheel assemblies attached thereto, the forwardmost of the wheel assemblies having a fixed straight-ahead orientation, and more than one of the remaining wheel assemblies including the rearwardmost assembly, having a caster-like construction allowing it to pivot about a vertical axis. There is spring means for biasing the wheel of each caster-like assembly in a straight-ahead position; however, each wheel can be pivoted substantially in one direction to a first inclined position and in the opposite direction to a second inclined position. The invention also features a pair of brake surfaces spaced apart from each other on opposite sides of the wheel on at least the rearward-most assembly. These brake surfaces are so disposed such that when the wheel is in its first inclined position it will make frictional engagement with one of the brake surfaces, and when the wheel is in its other inclined position it will frictionally engage the other brake surface. In one of the preferred embodiments there are four wheel assemblies, the forwardmost being fixedly oriented and the remainder being pivotable, and the brake means being used in association with the rearwardmost wheel assembly. In another variant there is a side plate that extends downwardly from each of the opposite sides of the base plate, each side plate having a lower edge portion to which is secured an auxiliary brake member, said brake member adapted to engage the ground when said skate is suitably canted about its longitudinal axis.

These and other features and advantages of the invention will become more clearly understood upon consideration of the following detailed description and accompanying drawings wherein like characters of reference designate corresponding parts throughout the several views and in which:

DETAILED DESCRIPTION OF THE PREFERRED EMBODIMENT

Figure 1:
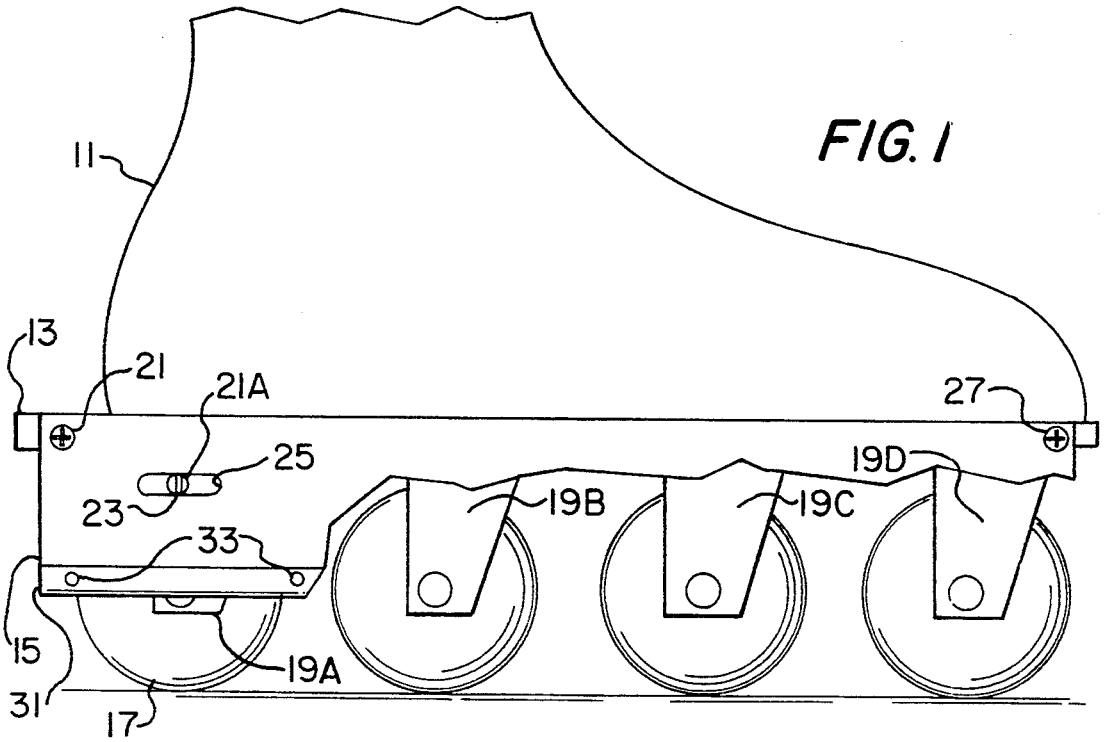
FIG. 1 is a side elevational view of the brake system of this invention.
Figure 2:
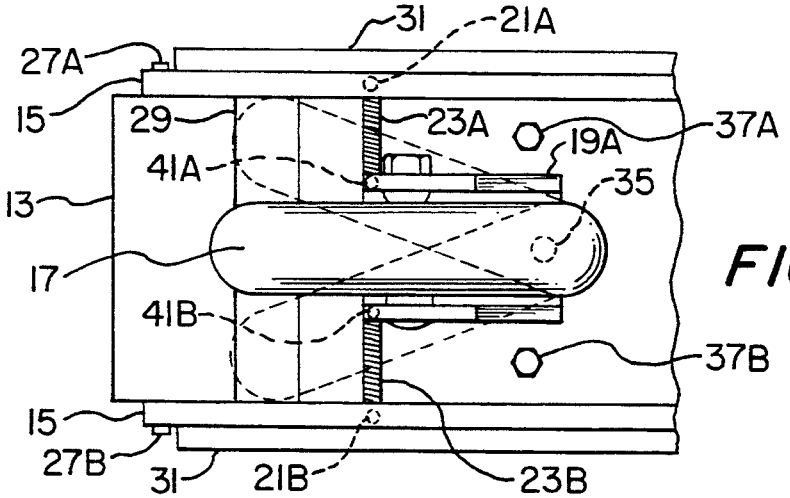
FIG. 2 is an enlarged bottom plan view of this invention.

Refer now to FIGS. 1 and 2. The skate boot 11 in FIG. 1 is secured to base plate 13 in the rear at points 37*a* and *b*. (Assume that all surfaces requiring securing have been drilled and tapped.) Base plate 13 is also secured at the front end of the boot with two additional fasteners. Next, side plate 15 is secured to base plate 13 at the front and rear with fasteners at points 27. Auxiliary brake member 31 is then attached to the side plate with spring-loaded fasteners 33. An oblong hole 25 is cut into the side plate, and retractable pins 21*a* and *b* are set into holes drilled and tapped into the top of said side plate. Elastic members 23*a* and *b* are then fastened to the pins.

Refer now to FIG. 2. Caster-like wheel support 19*a* is secured to base plate 13 at point 35 with a fastener that allows the wheel mount to swivel freely about a vertical axis even though it is securely fastened to the base plate. Next, retractable pins 41*a* and *b* are set into said wheel support, said wheel support having a notched-out area such that the pins are exposed (see FIG. 4). Finally, brake surface 29 is secured to base plate 13 with fastener 39, also shown in FIG. 4.

Figure 4:
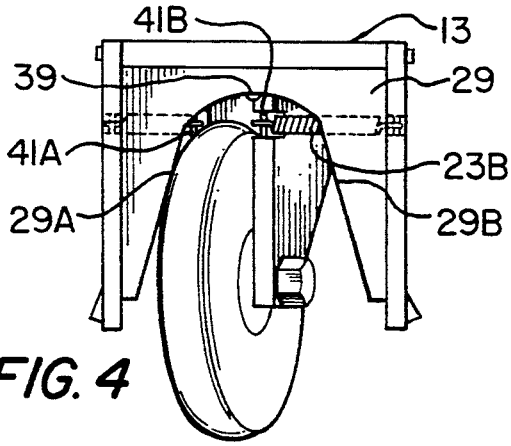
FIG. 4 is an enlarged rear elevational view of this invention in a braking configuration.
Figure 3:
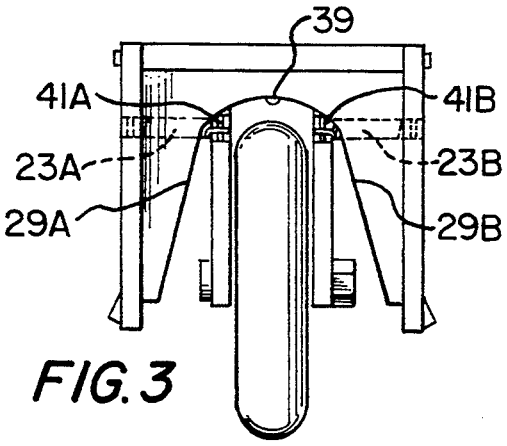
FIG. 3 is an enlarged rear elevational view of this invention in a straight-ahead configuration.

Refer now to FIGS. 3 and 4. FIG. 3 illustrates skate wheel 17 positioned along the longitudinal axis, while FIG. 4 illustrates skate wheel 17 abrading against brake surface 29 at point 29*a* after having been pivoted during braking. (Note: skate wheel 17 may also be pivoted in the opposite direction, causing it to abrade against brake surface 29 at point 29*b*.)

As described above, the invention is to be used as follows: The skater propels himself in the normal manner of in-line skating. In order to brake, the skater turns one or both skates sideways, causing the wheels to pivot and engage the brake surface, thereby causing the wheel to stop its forward motion. Additional braking capability can be achieved using the variant employing an auxiliary brake pad located along the lower edge of each side plate. To engage the auxiliary brake pad, the skater cants his foot during the braking procedure described above, thereby causing the auxiliary brake pad to abrade against the skating surface, thereby stopping the forward motion of the skater.

It is intended that the invention be given the full scope and breadth as defined in the claims which follow.

What is claimed is:

1. An in-line wheel roller skate, including:

a. a boot;

b. an elongate base plate having a top to which said boot is secured, opposite sides, a front and a rear, a longitudinal axis and an underside;

c. a plurality of wheel assemblies attached in-line to said base plate underside, said plurality of assemblies including a front assembly that supports a free-turning wheel in a fixed, straight-ahead orientation, said plurality of assemblies including a rear assembly and at least one assembly located intermediate to said rear and front wheel assemblies, and at least said rear assembly of said rear and intermediate assemblies mounting a wheel and having a pivotable wheel support that is connected to said base plate for rotation about a vertical axis, said pivotable wheel support having a straight-ahead position and being capable of pivoting in one direction to a first substantially inclined position with respect to a vertical plane through said longitudinal axis, and pivoted in the other direction to a second substantially inclined position with respect to said plane;

d. spring means for biasing each of said pivotable wheel supports, in their straight-ahead positions;

e. brake means, affixed to said base plate, and having first and second generally vertically-extending surfaces disposed in spaced-apart relationship on opposite sides of a wheel of at least one of said pivotable wheel supports, whereby the wheel of said pivotable support, in said first inclined position will make frictional engagement with said first brake surface, and the wheel of said pivotable support in its second inclined position will make frictional engagement with said second brake surface.

2. A skate as defined in claim 1 wherein said first and second brake surfaces diverge downwardly with respect to each other.

3. A skate as defined in claim 1 wherein said first and second brake surfaces are generally parallel to each other.

4. A skate as defined in claim 1 including first and second opposite spaced-apart side plates that extend downwardly from said base plate opposite sides, and wherein said spring means comprises a first spring member that extends between said first side plate and said wheel support and a second spring member that extends between the second side plate and said wheel support.

5. A skate as defined in claim 1 having four wheel assemblies including three pivotable wheel support, and wherein said brake means is provided for said rearwardmost assembly only.

6. A skate as defined in claim 1 including first and second opposite-spaced side plates that extend downwardly from said base plate opposite sides, each said side plate having a lower edge portion to which is secured an auxiliary brake member, said member adapted to engage the ground when said skate is substantially canted about its longitudinal axis.

7. A skate as defined in claim 6 wherein said brake member extends longitudinally along said lower edge.

* * * * *